US005516264A

United States Patent [19]

Anetrini

[11] Patent Number: 5,516,264

[45] Date of Patent: May 14, 1996

[54] CEILING FAN BLADE SLIP COVER

[76] Inventor: Dolores F. Anetrini, 23085 Columbus, Warren, Mich. 48089

[21] Appl. No.: 392,071

[22] Filed: Feb. 22, 1995

[51] Int. Cl.[6] ..... F04D 29/70

[52] U.S. Cl. ..... 416/62; 416/146 R

[58] Field of Search ..... 416/5, 62, 146 R

[56] References Cited

U.S. PATENT DOCUMENTS

| | | | |
|---|---|---|---|
| D. 341,881 | 11/1993 | Smith et al. . | |
| 2,288,592 | 7/1942 | Mirhige | 416/62 |
| 4,676,721 | 6/1987 | Hardee | 416/146 R |
| 4,832,572 | 5/1989 | Prucha et al. | 416/146 R |
| 5,281,093 | 1/1994 | Sedlak et al. | 416/146 R |

FOREIGN PATENT DOCUMENTS

| | | | |
|---|---|---|---|
| 196337 | 10/1986 | European Pat. Off. | 416/146 R |

OTHER PUBLICATIONS

"Fabric Fan" Article on p. 14 of *Home Mechanix*, Apr. 1994.

*Primary Examiner*—Edward K. Look
*Assistant Examiner*—James A. Larson
*Attorney, Agent, or Firm*—Peter D. Keefe

[57] ABSTRACT

A ceiling fan blade slip cover composed of a fitted case which is dimensioned to generally conform to the shape of a ceiling fan blade, wherein the mouth of the fitted case is closable about the arm of the ceiling fan blade. The mouth is used to install and remove the ceiling fan blade slip cover with respect to its respective ceiling fan blade. In this regard, it is preferred for the mouth to be provided with an elastic gather, and/or be provided with a releasable fastener, such as for example a VELCRO (trademark of Velcro, U.S.A.) type hook and loop fastener. A preferred material for the fitted case is a fabric having a selected color, pattern or other indicia thereupon which harmoniously matches the decor of the room. Other materials may be used, such as for example a sheet plastic or leather material. In the event a nonventilative material is used for the fitted case, one or more longitudinal slits are provided at the top side and a lateral slit is provided at each outboard corner thereof. The longitudinal and lateral slits provide internal air pressure relief when the ceiling fan blades rotate. In the event a ventilative material is used for the fitted case, neither the longitudinal nor the lateral slits would be needed.

20 Claims, 2 Drawing Sheets

CEILING FAN BLADE SLIP COVER

BACKGROUND OF THE INVENTION

1. Field of the invention

The present invention is related to ceiling fans, and more particularly to a slip cover for being removably placed upon the blades thereof.

2. Description of the Related Art

Ceiling fans have become increasingly popular for providing quiet air movement within a room. The air movement not only can provide a welcome breeze on hot summer days, it also serves on cold winter days to mix heated air in the room, thereby serving to reduce energy costs since thermal stratification of the room air is prevented.

Ceiling fans have relatively large blades, typically ranging in length from 36 to 52 inches, and usually the number thereof is three, four or five, depending upon the model of ceiling fan. Each of the blades is connected to a shaft of a fan motor. Each of the blades has a relatively flat cross-section which is angled relative to horizontal so that rotation in one direction will draw air downwardly and rotation in the other direct/on will draw air upwardly. The blades connect with the shaft via a connection member. Each connection member connects with an inboard end of a blade and has an arm which connects with the shaft. Ceiling fan blades come in a variety of types, but in general there are three types of blades which have become generally standard: a blade having substantially parallel edges and a rounded outboard end, a blade having diverging edges and a straight outboard end, and a blade having substantially parallel edges and a tipped outboard end.

Ceiling fans are available in a variety of styles, the styles including not only the fan housing but also the blades thereof. Problematically, however, the styles available are necessarily quite limited. What is more, rooms having a coordinated decor, such as matching wall paper and curtains, may not harmoniously blend with any of the available styles of ceiling fans, particularly the blades thereof.

Consequently, it would be most beneficial if somehow the blades of a ceiling fan could be selectively decorated in a manner pleasingly harmonious with the room decor.

In this regard, Wineta, Inc. of Dallas, Tex. offers a product which replaces the conventional blades of a ceiling fan with a fabric stretched across a frame. These fabric fan blades may be customized to harmonize with a particular room decor, but problematically the original blades must be discarded. Therefore, it remains a problem to be solved in the art as to how a decorative look could be provided to the original fan blades of a ceiling fan.

Another aspect of ceiling fans is their tendency to collect dust. It is a major chore to frequently dust or otherwise clean the blades, so that some solution to this onerous task would be very beneficial.

U.S. Design Pat. No. 341,881 to Smith et al, dated Nov. 30, 1993, discloses a dust collector for blades of a ceiling fan in the form of a thin, narrow strip that connects to a side of the blades adjacent an edge thereof. Because this is a design patent, it is left to the imagination as to whether the strip is applied to the top side or the bottom side of the blades, and whether the strip should be placed adjacent a leading or a trailing edge. Since the strip appears to cover only a fraction to the blades surface, it would seem that dust could still collect on the uncovered surface of the blades, whereupon dusting or otherwise cleaning of the blades may yet be necessary, especially the top surface of the blades of ceiling fans that are used very infrequently. Accordingly, it remains a problem in the art how to provide easy and simple cleaning of the blades.

SUMMARY OF THE INVENTION

The present invention is a ceiling fan blade slip cover which provides for selective decoration of ceiling fan blades in a manner pleasingly harmonious with the room decor, and further provides for easy and simple cleaning of the ceiling fan blades.

The ceiling fan blade slip cover according to the present invention is composed of a fitted case which is dimensioned to generally conform to the shape of a ceiling fan blade, wherein the mouth of the fitted case is closable about the arm of the ceiling fan blade. The mouth is used to install and remove the ceiling fan blade slip cover with respect to its respective ceiling fan blade. In this regard, it is preferred for the mouth to be provided with an elastic gather, and/or be provided with a releasable fastener, such as for example a VELCRO (trademark of Velcro, U.S.A.) type hook and loop fastener.

A preferred material for the fitted case is a fabric having a selected color, pattern or other indicia thereupon which harmoniously matches the decor of the room. For example, the indicia may match indicia, such as a flower pattern, of the curtains, valences, bedding, furniture, or carpet of the room.

While a fabric is preferred for the fitted case material, other materials may be used, such as for example a sheet plastic or leather material. In the event a fine weave fabric or another generally nonventilative material (such as leather, vinyl or plastic) are used for the fitted case, one or more longitudinal slits are provided at the top side and a lateral slit is provided at each outboard corner thereof. The longitudinal and lateral slits provide internal air pressure relief when the ceiling fan blades rotate to thereby prevent the fitted case from puffing, as would otherwise occur. In the event a coarse or open weave fabric, or another recticulated or otherwise ventilative material is used for the fitted case, neither the longitudinal nor the lateral slits would be needed, as air will pass freely through the fitted case without causing puffing thereof.

In operation, a ceiling fan blade slip cover is provided for each of the blades of a selected ceiling fan. Each ceiling fan blade slip cover is placed on its respective blade by the outboard end of the blade being received into the fitted case through the opened mouth thereof. When the blade is entirely received into the fitted case, the mouth is closed tightly about the arm so that there is no chance for the ceiling fan blade slip cover to accidentally become dislodged from the blade while the ceiling fan is operating.

Accordingly, it is an object of the present invention to provide a ceiling fan blade slip cover for each of the blades of a ceiling fan.

It is an additional object of the present invention to provide a ceiling fan blade cover which is selectively decorated to match a decor of the room in which the ceiling fan is located.

It is yet another object of the present invention to provide a ceiling fan blade slip cover which is easily installed, easily removed and easily cleaned.

It is yet a further object of the present invention to provide a ceiling fan blade cover which is easily replaceable to thereby provide a ceiling fan blade slip cover that is decorated to match a changed decor of the room in which the ceiling fan is located.

It is still another object of the present invention to provide a ceiling fan blade slip cover which protects the ceiling fan blades from becoming dusty or otherwise soiled.

These, and additional objects, advantages, features and benefits of the present invention will become apparent from the following specification.

DETAILED DESCRIPTION OF THE PREFERRED EMBODIMENT

Figure 1:
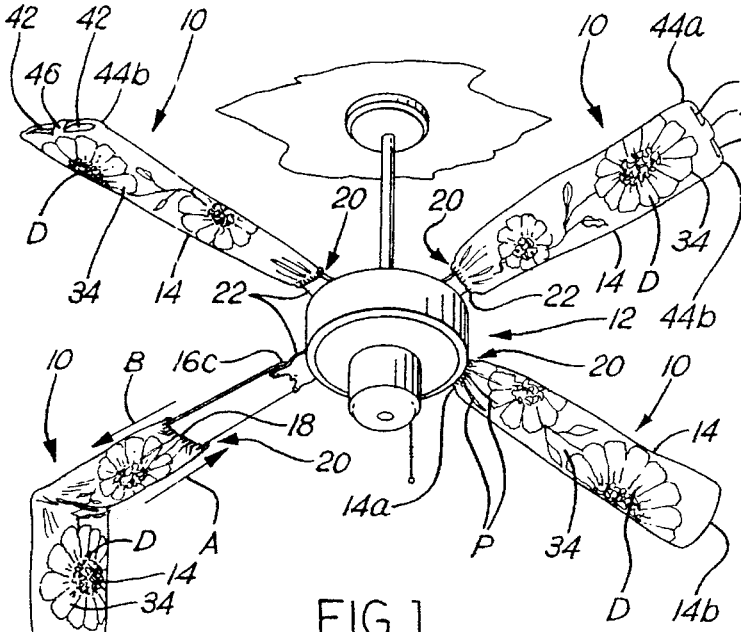
FIG. 1 is a perspective view of the ceiling fan blade slip cover according to the present invention, shown in operation with respect to a conventional ceiling fan.

Referring now to the Drawing, FIG. 1 generally shows the ceiling fan blade slip cover 10 according to the present invention installed on a conventional ceiling fan 12. The ceiling fan blade slip cover 10 includes a fitted case 14 which generally conforms to the shape of a ceiling fan blade 16. The fitted case 14 has a selectively openable and closable mouth 18 for providing an entry location for the ceiling fan blade 16 to be received thereinto. The mouth 18 of the fitted case 14 is provided with one or more closure mechanisms 20 for tightly closing the mouth with respect to the arm 22 of the ceiling fan blade 16. The ceiling fan blade slip cover 10 is easily installed and removed from its respective ceiling fan blade 16 by selective operation of the closure mechanism 20 thereof, thereby facilitating cleaning or replacement thereof.

Referring additionally now to FIGS. 2 through 8, the structure and function of the ceiling fan blade slip cover 10 according to the present invention will be detailed with greater specificity.

Figure 7:
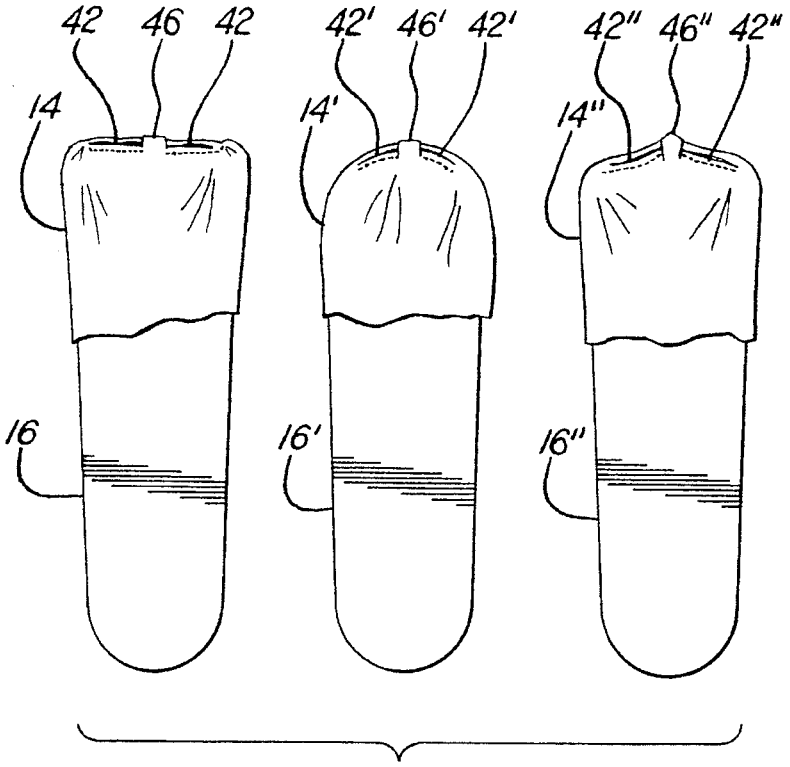
FIG. 7 is a partly broken away bottom plan view of examples of the the ceiling fan blade slip cover according to the present invention, shown fitted with respect to each of three common types of ceiling fan blades.

As can be understood from reference to FIG. 1, a ceiling fan blade slip cover 10 is provided for each ceiling fan blade 16 of a selected ceiling fan 12. In this regard, the fitted case 14 is dimensioned to receive entirely therein side the ceiling fan blade 16 with more or less slack as desired between the edges 16*a*, 16*b* and between the inboard and outboard ends 16*c*, 16*d* of the ceiling fan blade, wherein a general conformance to the shape of the ceiling fan blade is provided. In this regard, when the mouth 18 is closed by the closure mechanism 20, it is preferred for the fitted case 14 to form pleats P, wherein the pleating increases toward the closed mouth. In any event, the fitted case 14 substantially conforms dimensionally to the shape of the ceiling fan blade 16 that is received thereinside. In this regard, FIG. 7 shows how the fitted case 14, 14' and 14" fits with respect to the outboard end of three typical types of ceiling fan blades 16, 16', 16".

Figure 2:
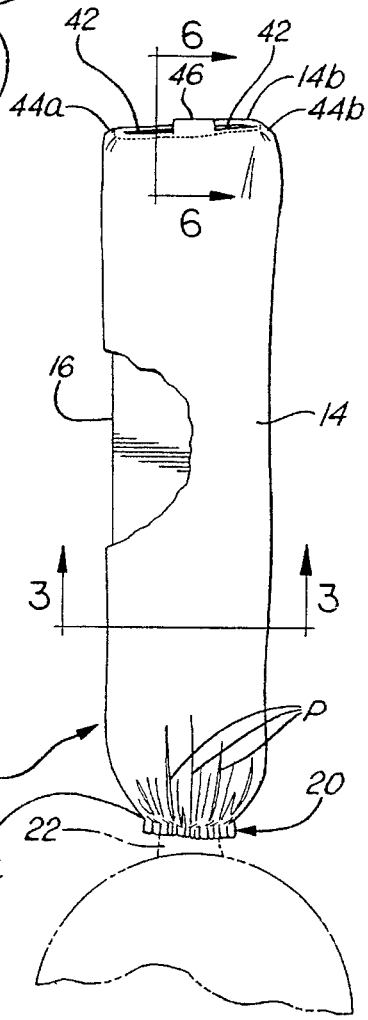
FIG. 2 is a partly broken away bottom plan view of the ceiling fan blade slip cover according to the present invention, seen installed on a ceiling fan blade.
Figure 4:
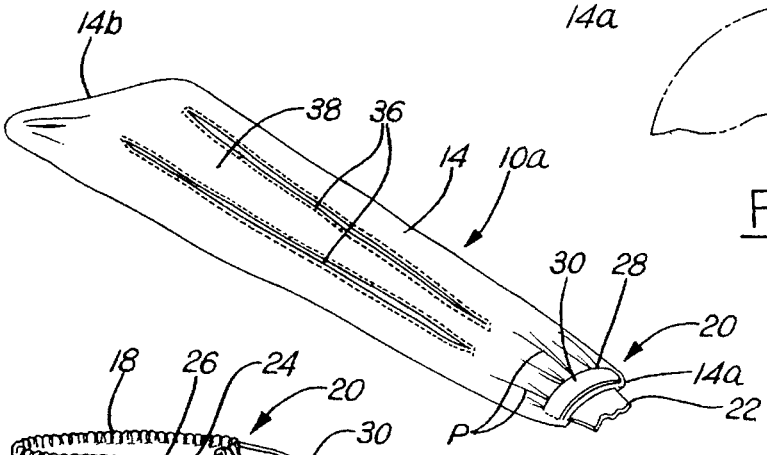
FIG. 4 is a perspective view of the ceiling fan blade slip cover according to the present invention installed on a ceiling fan blade, showing the top side thereof.
Figure 5:
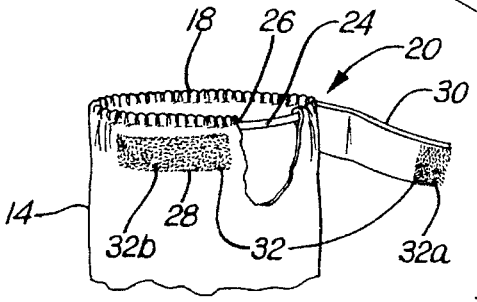
FIG. 5 is a detail, partly broken away perspective view of a ceiling fan blade slip cover according to the present invention, showing an open mouth of the fitted case thereof.
Figure 6:
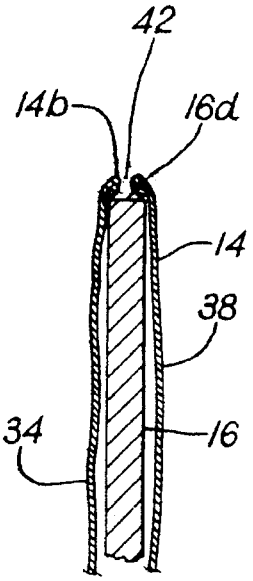
FIG. 6 is a sectional side view of the ceiling fan blade slip cover according to the present invention installed on a ceiling fan blade, seen along line 6—6 in FIG. 2.

When the fitted case 14 has received thereinside its respective ceiling fan blade 16, the mouth 18 is then closed upon a suitable portion of the arm 22. As shown in FIGS. 2 and 5, the closure mechanism 20 for closing the mouth 18 upon the arm 22 is preferably via an elastic band 24 formed in the end seam loop 26 of the mouth. Additionally, or alternatively, the closure mechanism 20 may be via a releasable fastener 28 as shown in FIGS. 4 and 5. A preferred releasable fastener 28, is in the form of a tab 30 connected to the fitted case adjacent the mouth, wherein the tab has thereon one component 32*a* of a two component hook and loop fastener 32, and a selected location on the fitted case adjacent the mouth has the other component 32*b* of the hoop and loop fastener. A well known and preferred hook and loop fastener is VELCRO (trademark of Velcro U.S.A.). The locations of the hook and loop fastener components 32*a*, 32*b* adjacent the mouth 18 are predetermined to provide a range of mouth closure cross-sections which would accommodate a range of cross-sections of conventional arms 22. Other forms of releasable fastener can include a snap or a zipper. A releasable fastener in the form of a drawstring can be used in place of the elastic band. Because the arm 22 has a cross-section less than the width of the ceiling fan blade 16, the closure mechanism 20 provides a secure abutment of the mouth 18 with the inboard end 16*c* of the ceiling fan blade.

The bottom side 34 of the fitted case 14 is preferably provided with a selected decoration D, as for example flowers as shown in FIG. 1. The decoration may be in the form of a pattern, a color or series of colors, a fanciful indicia, or otherwise (limited only by the imagination). Desirably, the decoration D is selected to harmonize with some decoration of the room into which the ceiling fan 12 is located. For example, a decoration of the carpet, bedding, or drapes may be likewise placed upon at least the bottom side 34 of the fitted case 14. In the event the room decor later changes, the ceiling fan blade slip cover 10 on each of the ceiling fan blades 16 may be changed to thereby retain the harmony of the ceiling fan with the room in which it is located.

The fitted case 14 is preferred to be constructed of a fabric material, but other materials are usable. Indeed, the material of the fitted case 14 may be elastic or inelastic, ventilative or nonventilative. Examples of materials include, fine (or closed) weave fabrics, leather, vinyl, plastic, and coarse (or open) weave fabrics.

In the event a material for the fitted case 14 is selected from a nonventilative material, such as fine weave fabrics, leather, vinyl or plastic, operation of the ceiling fan will result in a tendency for the fitted case to puffably swell due to the air pressure within the fitted case exceed the air pressure external to the fitted case. This condition does not arise with ventilative materials, such as net-like, reticulated fabrics; an example of which being casement fabrics, wherein a uniform distribution of openings (on the order of about one-quarter inch in cross-section) provides inherent air pressure relief.

Figure 3:
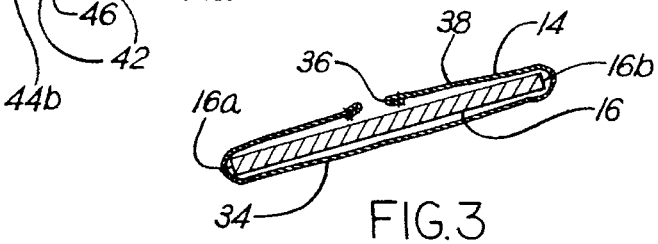
FIG. 3 is a sectional end view of the ceiling fan blade slip cover according to the present invention installed on a ceiling fan blade, seen along line 3—3 in FIG. 2.

To redress puff age of the fitted case 14 during operation of the ceiling fan 12, ventilation of nonventilative material of the fitted case must be provided. A preferred form of ventilation is via one or more longitudinal slits 36, extending generally from the proximities of the inboard and outboard ends 14*a*, 14*b* of the fitted case 14, are provided at the top side 38 of the fitted case. Two mutually separated longitudinal slits 36, as shown in FIG. 4, are preferred, although as shown in FIG. 3, one centrally disposed longitudinal slit 36 will ordinarily suffice. Alternatively, the ventilation of the fitted case may be in the form of a plurality of openings distributed over the top side, such as for example as would be provided by a reticulated material, such as a casement fabric.

Figure 8:
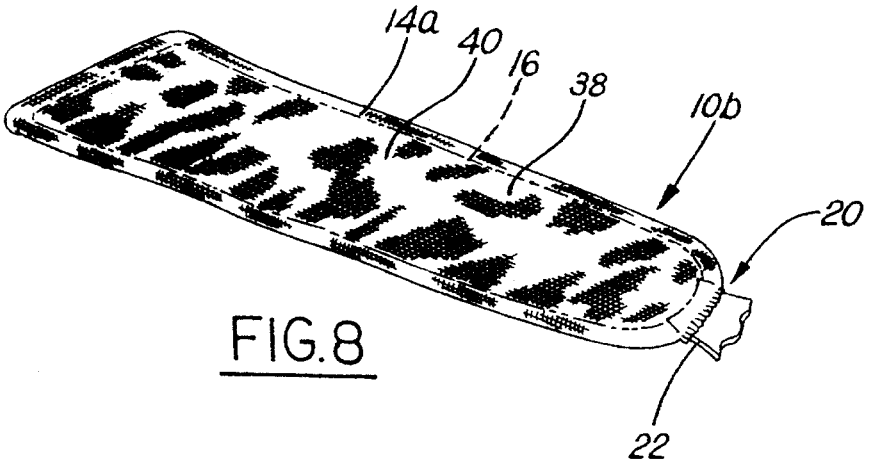
FIG. 8 is a perspective view of the ceiling fan blade slip cover according to the present invention installed on a ceiling fan blade, showing the top side of a fitted case composed of a coarsely woven or otherwise recticulated material.

An example of a ceiling fan blade slip cover 10b having an inherently ventilated fitted case is depicted in FIG. 8. While the entire fitted case may be composed of a reticulated or otherwise ventilative material, it is also possible that only the top side 38 is so provided, wherein the bottom side (not shown in FIG. 8) is composed of a nonventilative material, and wherein a sewing seam connects the two materials together to form a fitted case 14*a*.

To further redress puffage of the fitted case during operation of the ceiling fan 12, a lateral slit 42 is provided at each of the outboard corners 44*a*, 44*b*. The lateral slits 42 are separated by a closed end portion 46. The lateral slits 42, which may have any suitable shape, provide air relief at the outboard end 14*b* of a fitted case 14 composed of a nonventilative material, wherein centrifugal force tends to move thereto any air contained within the fitted case. FIG. 7 shows the lateral slits 42, 42', 42" and the closed portion 46, 46', 46" for three types of ceiling fan blades 16, 16', 16". Where a reticulated or otherwise ventilative material is used, lateral slits are unnecessary.

In operation, the user ordinarily selects or provides a selected decoration on at least the bottom side 34 of the fitted case 14 of each of the ceiling fan blade slip covers 10 needed to cover each and every blade 16 of the selected ceiling fan 12, wherein the selected decoration is the same, or otherwise is harmonious with, the decor of the room in which the ceiling fan is located.

The user then takes each ceiling fan blade slip cover, and successively places them on respective blades of the ceiling fan. In this regard, the mouth 18 of the fitted case is opened and the outboard end 16*d* of a respective ceiling fan blade is inserted thereinto, and the mouth is slid along the blade toward its inboard end 16*c*, as shown by arrow A in FIG. 1.

When the mouth has reached the arm 22 of the respective ceiling fan blade, the user then effects closure of the mouth via the closure mechanism 20. This may be as simple as letting the elastic band 24 thereof compressibly encircle the arm, or this may involve alternatively or in addition thereto, the closing of a releasable fastener such as closing together the two components of a hook and loop fastener, or pulling a drawstring closed and then tying it so.

When it comes time to clean, replace or change the ceiling fan blade slip covers, the user simply effects opening of the mouth via reversing the closure mechanism, and then slipping the fitted case off the blade, as shown by arrow B in FIG. 1. Cleaning may be effected by any suitable washing modality, such as via a washing machine. Re-installation of the ceiling fan blade slip cover is as indicated hereinabove.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A ceiling fan blade slip cover for covering a ceiling fan blade of a ceiling fan, wherein the ceiling fan blade is connected with the ceiling fan via an arm, said ceiling fan blade slip cover comprising:

a fitted case having a mouth, said fitted case being dimensioned to substantially conformably receive thereinside the ceiling fan blade, said fitted case having a top side, a bottom side opposite said top side and an outboard end opposite said mouth;

ventilation means for providing passage of air freely through said fitted case; and closure mechanism means connected with said mouth for selectively closing said mouth;

wherein when the ceiling fan blade is received in said fitted case, said closure mechanism means provides a tight closure of said mouth about the arm of the ceiling fan blade to thereby securably hold the fitted case with respect to the ceiling fan blade when the ceiling fan thereof is in operation.

2. The ceiling fan blade slip cover of claim 1, wherein said ventilation means comprises said top side of said fitted case comprising at least in part a ventilative material that passes air freely therethrough.

3. The ceiling fan blade slip cover of claim 1, wherein said outboard end of said fitted case has a pair of corners; wherein said ventilation means comprises:

at least one longitudinal slit formed in said top side of said fitted case; and each corner of said pair of corners being provided, respectively, with a lateral slit, each lateral slit of each said corner being separated by a closed end portion of said fitted case.

4. The ceiling fan blade slip cover of claim 1, wherein said closure mechanism means comprises an elastic band connected with said mouth of said fitted case.

5. The ceiling fan blade slip cover of claim 4, wherein said closure mechanism means further comprises a releasable fastener connected with said fitted case adjacent said mouth thereof.

6. The ceiling fan blade slip cover of claim 1, wherein said closure mechanism means comprises a releasable fastener connected with said fitted case adjacent said mouth thereof.

7. The ceiling fan blade slip cover of claim 6, wherein said releasable fastener comprises:

a strap connected with said fitted case adjacent said mouth; and hook and loop fastener means for providing releasable connection between a first component thereof and a second component thereof;

wherein said first component is located on said strap, and said second component is located at a selected location on said fitted case adjacent said mouth.

8. The ceiling fan blade slip cover of claim 1, wherein said bottom side of said fitted case is provided with a predetermined decoration.

9. The ceiling fan blade slip cover of claim 1, wherein closure of said mouth provides pleats in said fitted case.

10. A ceiling fan blade slip cover for covering a ceiling fan blade of a ceiling fan, wherein the ceiling fan blade is connected with the ceiling fan via an arm, said ceiling fan blade slip cover comprising:

a fitted case having a mouth, said fitted case being dimensioned to substantially conformably receive therein side a the ceiling fan blade, said fitted case having a top side, a bottom side opposite said top side and an outboard end opposite said mouth, said bottom side of said fitted case being provided with a predetermined decoration;

ventilation means for providing passage of air freely through said fitted case; and closure mechanism means connected with said mouth for selectively closing said mouth, wherein a plurality of pleats are formed in said fitted case when said mouth is closed;

wherein when the ceiling fan blade is received in said fitted case, said closure mechanism means provides a tight closure of said mouth about the arm of the ceiling fan blade to thereby securably hold the fitted case with respect to the ceiling fan blade when the ceiling fan thereof is in operation.

11. The ceiling fan blade slip cover of claim 10, wherein said ventilation means comprises said top side of said fitted case comprising at least in part a ventilative material that passes air freely therethrough.

12. The ceiling fan blade slip cover of claim 11, wherein said closure mechanism means comprises an elastic band connected with said mouth of said fitted case.

13. The ceiling fan blade slip cover of claim 12, wherein said closure mechanism means further comprises a releasable fastener connected with said fitted case adjacent said mouth thereof.

14. The ceiling fan blade slip cover of claim 10, wherein said closure mechanism means comprises a releasable fastener connected with said fitted case adjacent said mouth thereof.

15. The ceiling fan blade slip cover of claim 14, wherein said releasable fastener comprises:

a strap connected with said fitted case adjacent said mouth; and hook and loop fastener means for providing releasable connection between a first component thereof and a second component thereof;

wherein said first component is located on said strap, and said second component is located at a selected location on said fitted case adjacent said mouth.

16. The ceiling fan blade slip cover of claim 10, wherein said outboard end of said fitted case has a pair of corners; wherein said ventilation means comprises:

at least one longitudinal slit formed in said top side of said fitted case; and each corner of said pair of corners being provided, respectively, with a lateral slit, each lateral slit of each said corner being separated by a closed end portion of said fitted case.

17. The ceiling fan blade slip cover of claim 16, wherein said closure mechanism means comprises an elastic band connected with said mouth of said fitted case.

18. The ceiling fan blade slip cover of claim 17, wherein said closure mechanism means further comprises a releasable fastener connected with said fitted case adjacent said mouth thereof.

19. The ceiling fan blade slip cover of claim 16, wherein said closure mechanism means comprises a releasable fastener connected with said fitted case adjacent said mouth thereof.

20. The ceiling fan blade slip cover of claim 19, wherein said releasable fastener comprises:

a strap connected with said fitted case adjacent said mouth; and hook and loop fastener means for providing releasable connection between a first component thereof and a second component thereof;

wherein said first component is located on said strap, and said second component is located at a selected location on said fitted case adjacent said mouth.

* * * * *